US006431914B1

(12) United States Patent
Billman

(10) Patent No.: US 6,431,914 B1
(45) Date of Patent: Aug. 13, 2002

(54) GROUNDING SCHEME FOR A HIGH SPEED BACKPLANE CONNECTOR SYSTEM

(75) Inventor: Timothy B. Billman, Dover, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/874,621

(22) Filed: Jun. 4, 2001

(51) Int. Cl.[7] ..... H01R 13/648
(52) U.S. Cl. ..... 439/608; 439/701
(58) Field of Search ..... 439/608, 701, 439/607, 95–99, 101, 108

(56) References Cited

U.S. PATENT DOCUMENTS 4,824,383 A * 4/1989 Lemke ..... 439/108
5,531,606 A * 7/1996 Rodrigues et al. ..... 439/188
6,146,202 A * 11/2000 Ramey et al. ..... 439/608

* cited by examiner

*Primary Examiner*—Khiem Nguyen
(74) *Attorney, Agent, or Firm*—Wei Te Chung

(57) ABSTRACT

A modular electrical connector comprising a plurality of wafers and shielding plates, each wafer having an insulative housing and a plurality of contact elements extending therethrough, the wafer having two side surfaces with slots formed therethrough to isolate each adjacent pair of contact elements within the wafer, each shielding plate having a plurality of ribs extending outwardly from at least one of two side surfaces thereof and being mounted between two adjacent wafers with each rib fitted within a corresponding slot to shield each adjacent pair of contact elements.

9 Claims, 5 Drawing Sheets

GROUNDING SCHEME FOR A HIGH SPEED BACKPLANE CONNECTOR SYSTEM

BACKGROUND OF THE INVENTION

1. Field of the Invention

The present invention relates to modular electrical connectors used to interconnect printed circuitboards, and particularly to such electrical connectors assembled from wafers.

2. Brief Description of the Prior Art

Electrical connectors are used in many electronic systems. It is generally easier to manufacture a system from several printed circuit boards which are joined together with electrical connectors. A traditional arrangement for joining several printed circuit boards is to have one printed circuit board as a backplane. Other printed circuit boards, called daughter boards, are connected to each other through the backplane.

A traditional backplane is a printed circuit board with many connectors. The traditional electrical connector for use with printed circuit boards is high speed, high density. The connector is configured by a plurality of wafers with a plurality of signal contacts formed therethrough and a shielding plate arranged between wafers. Apparently, arranging a first shielding between two wafers is disclosed and known to the skill in the art, however, how to provide a second shielding between two adjacent pair of signal contacts within the same wafer is not disclosed. Examples of electrical connectors with similar structures are those disclosed in U.S. Pat. Nos. 5,860,816, 5,980,321, and 5,993,259.

Hence, an improved electrical connector is required to overcome the disadvantages of the prior art.

BRIEF SUMMARY OF THE INVENTION

The object of the present invention is to provide an electrical connector capable of providing an effective shielding between two adjacent pair of signal contacts.

To achieve the above-mentioned objects, a connector in accordance with the present invention includes a plurality of wafers and shielding plates. Each wafer includes an insulative housing and a plurality of contact elements extending through the housing. The wafer includes two side surfaces with slots formed therethrough to isolate each adjacent pair of contacts within the wafer. Each shielding plate comprises a plurality of ribs extending outwardly from at least one of the two side surfaces. Each shielding plate is mounted between two adjacent wafers with each rib fitted within a corresponding slot to shield each adjacent pair of contact elements.

Other objects, advantages and novel features of the present invention will become more apparent from the following detailed description of the present embodiment when taken in conjunction with the accompanying drawings.

DETAILED DESCRIPTION OF THE INVENTION

Figure 1:
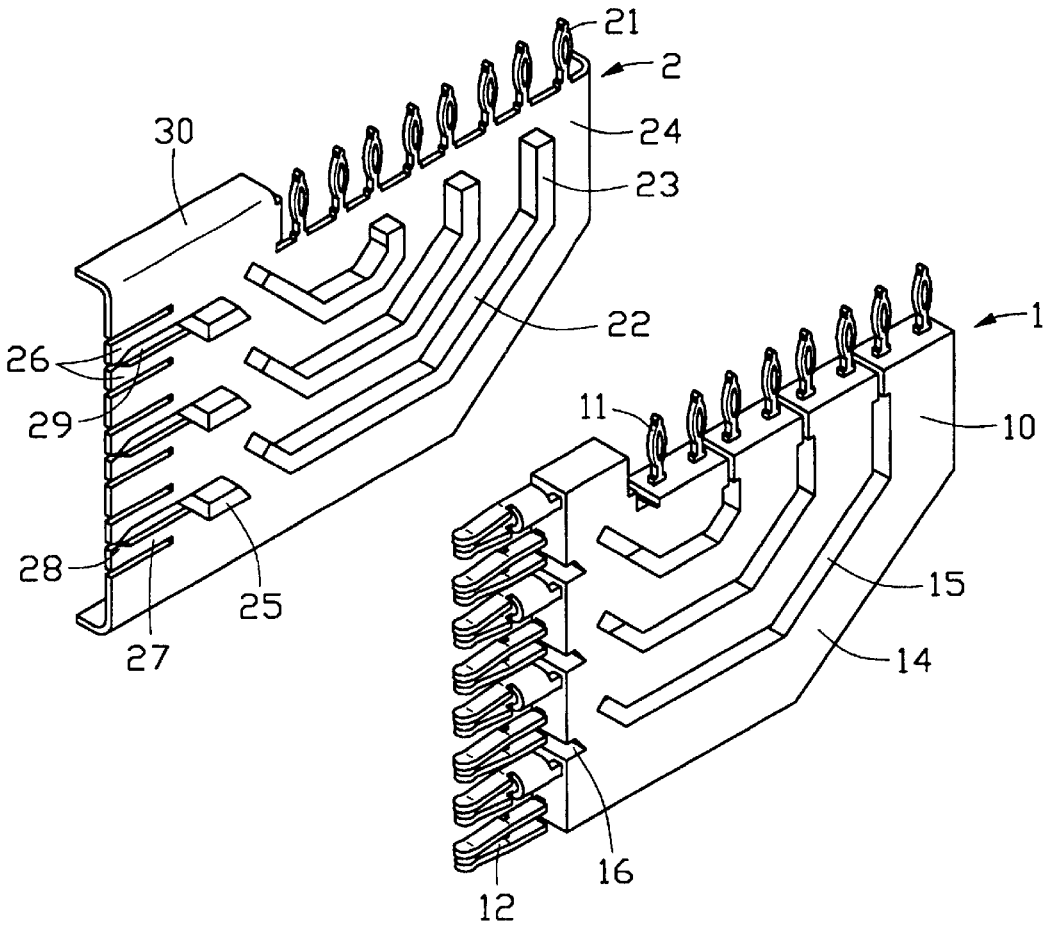
FIG. 1 is a perspective view of a shielding plate and a wafer of a modular connector in accordance with the present invention.

Referring to FIG. 1, a modular connector 100 in accordance with the present invention is constructed from wafers 1 and shielding plates 2.

Each wafer 1 contains one column of contact elements injection molded into the housing 10 to form a wafer. In the embodiment shown, the contact elements have contact regions in the form of press fit tails 11 and receptacle contacts 12. The press fit tails 11 and receptacle contacts 12 extend from the insulative housing 10 at right angles. Connector 100 is therefore a "right angle" connector. Each contact element also includes a signal contact 13 formed within the housing (see FIG. 4). Each wafer 1 has two side surfaces 14, and a plurality of slots 15 extending therethrough. Thus the slots 15 isolate each adjacent pair of contacts within the wafer 1. A plurality of recesses 16 is formed in one end of the insulative housing 10 that the receptacle contacts 12 extend therefrom. Each recess 16 is situated between adjacent pair of receptacle contacts 12.

The shielding plates 2 are formed of conductive plates in the profile similar to the housing 1. The shielding plate 2 includes two opposed side surfaces 24 and a plurality pairs of ribs 22 extending outwardly from each side surface 24. Each pair of the ribs 22 is symmetrical to the shielding plate 2. Each rib 22 includes an outer surface 23. The distance between the outer surface 23 of the rib 22 and the side surface 24 is about half that of the wafer 1 between two side surfaces 14 (see FIG. 4). Each rib 22 is in the same profile to the corresponding slot 15 formed in the wafer 1, and the distance between adjacent two ribs 22 is same to that of two corresponding slots 15. So each rib 22 can easily engage with one slot 15. A plurality of channels 31 is formed between adjacent two ribs 22 for receiving the wafer 1.

Each shielding plate 2 also has press fit tails 21 and receptacle contacts 26 extending from two ends of the shielding plate 2 in the same directions as the press fit tails 11 and receptacle contacts 12 formed in the wafer 1. The receptacle contact 26 is stamped as fork-shaped and includes two parallel arms 27 extended from the shielding plate 2. A protrusion 28 inwardly extends from a free end of each arm 27. A cutout 29 is stampingly formed between the two arms 27 of each receptacle contact 26. Two projections 25 are formed symmetrical to the shielding plate 2 at the end of each cutout 29. Each projection 25 extends outwardly from the side surface 24 for engaging with the recesses 16 formed in the wafer 1.

Figure 2:
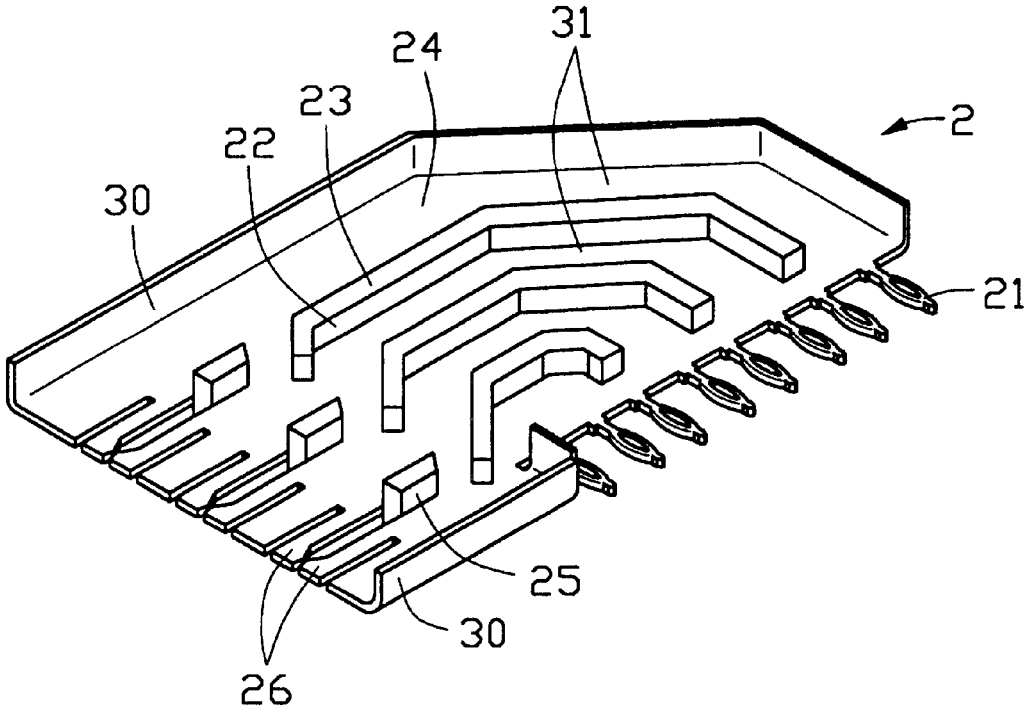
FIG. 2 is another perspective view of the shielding plate shown in FIG. 1.

Further referring to FIG. 2, receiving plates 30 are formed at the edge of the shielding plate 2 between the press fit tails 21 and receptacle contacts 26. Each receiving plate 30 extends to the same side vertical to the side surface 24. The length of the receiving plates 30 is substantially similar to the thickness of the wafer 1. A channel 31 is also formed between the rib 22 and the receiving plate 30.

Figure 3:
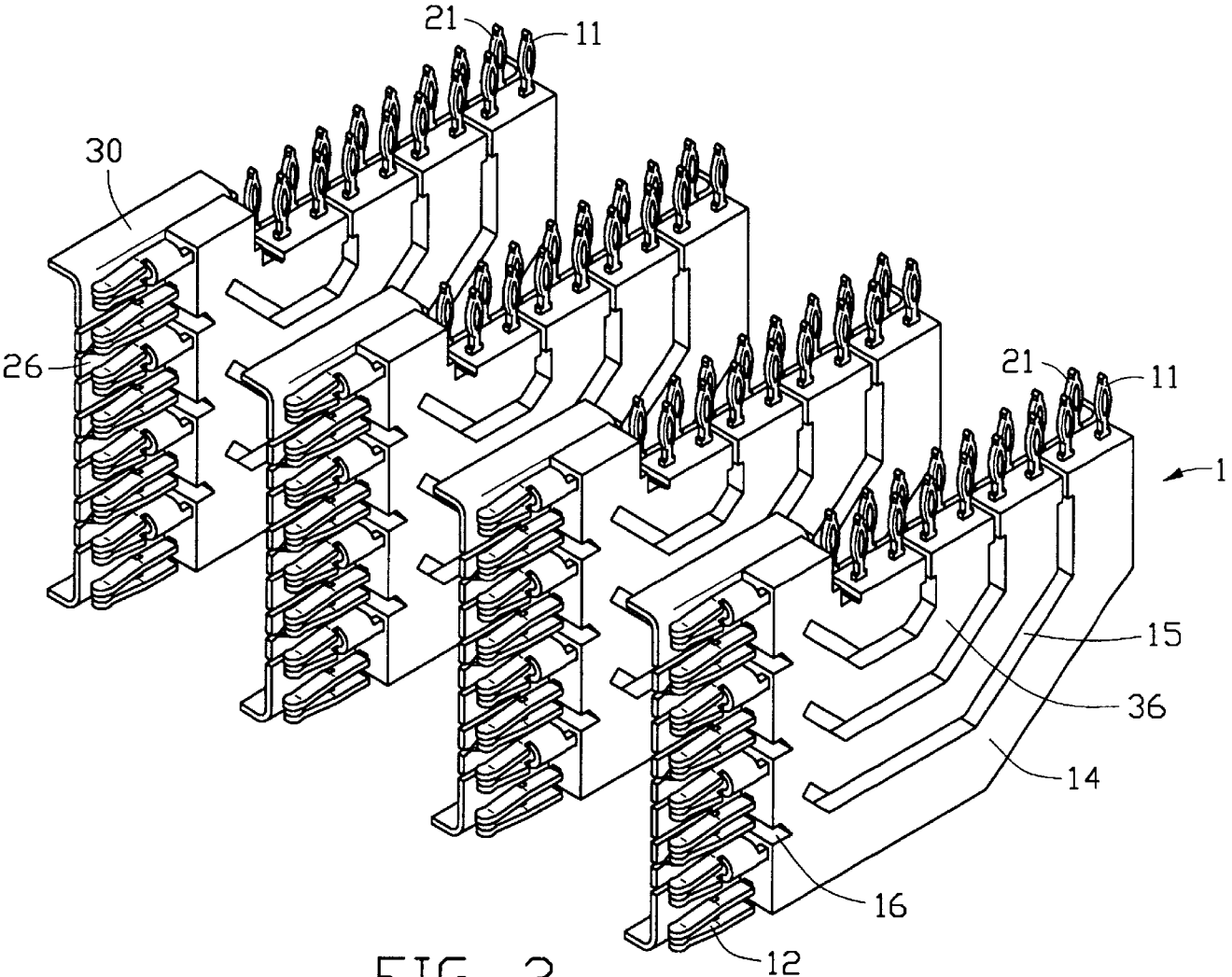
FIG. 3 is a partly assembled view of the modular connector where each shielding plate is engaged with one wafer.
Figure 4:
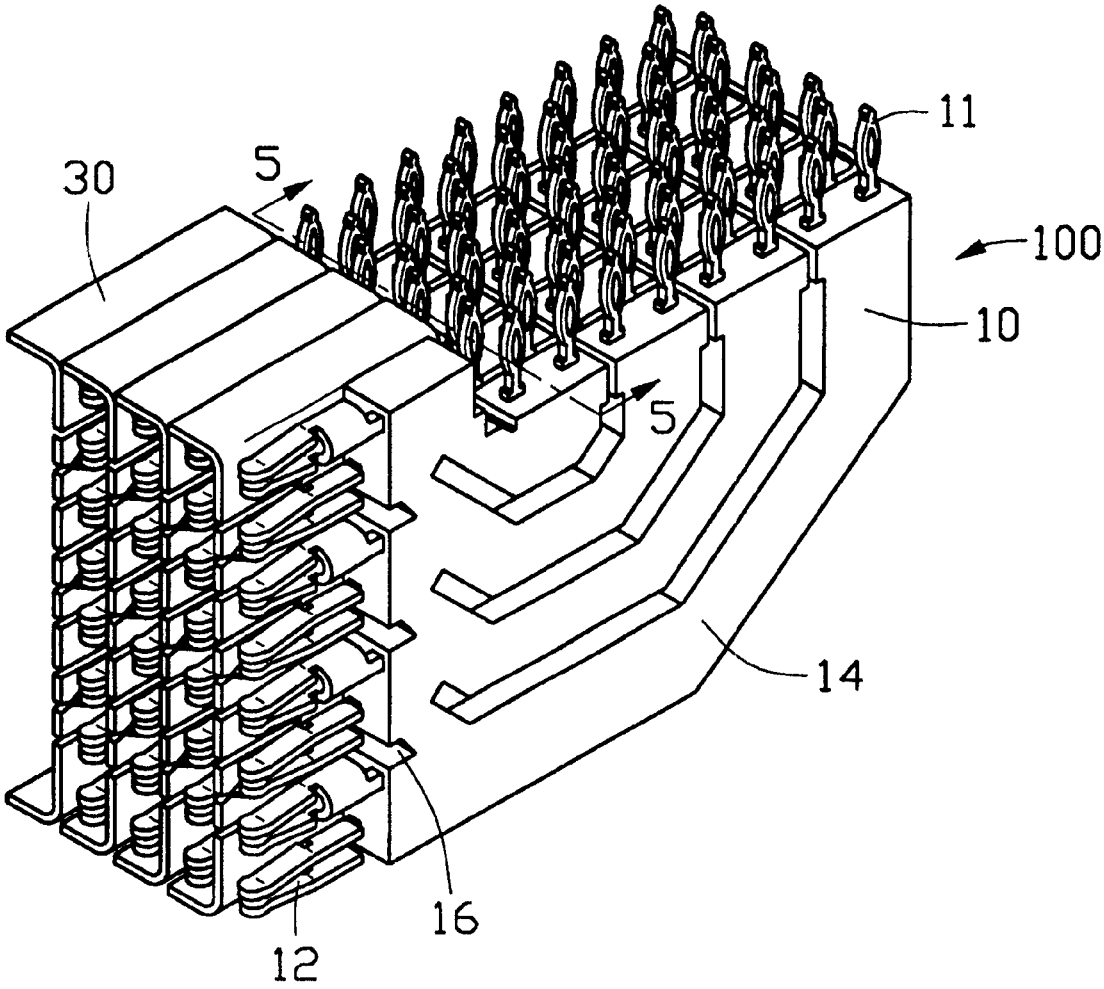
FIG. 4 is an assembled view of the modular connector in accordance with the present invention.

In assembly, referring to FIGS. 3 and 4, each shielding plate 2 engages with a wafer 1, as the profile of each rib 22 is same to the corresponding slot 15, and the distance between adjacent two ribs 22 is same to that of two corresponding slots 15 Each rib 22 is easily mounted into the corresponding slot 15. Each projection 25 formed in the shielding plate 2 engages with one recess 16 in the wafer 1 for securing the shielding plate 2 from moving relative to the wafer 1.

When a shielding plate 2 is engaged with one wafer 1, it forms a modular means 101. Then every modular means 101 engages each other. The ribs 24 formed in the shielding plate 2 of one modular means 101 engage with the slots 15 of another adjacent modular means 101. The projections 25 of one modular means 101 are mounted into the recesses 16 of the other. When assembled, the receiving plate 30 of one modular means 101 moves along the edge of the wafer 1 of another modular means 101 until it abuts against the receiving plate 30 of the modular means 101 to which it is mounted. So the wafer 1 is partly shielded by the receiving plates 30 of adjacent modular. At this time, the side surface 24 of the shielding plate 2 abuts against the side surface 14 ofthe wafer 1. The outer surfaces 23 of two ribs 22 that are received in the same slot 15 substantially touch each other. Thus the shielding plates 2 and the ribs 22 surround adjacent pair of signal contacts 13 (see FIG. 5). When all modular means 101 are engaged together, the modular connector 100 is formed (see FIG. 4).

The press fit tails 21 and receptacle contacts 26 formed in the shielding plate 2 are used to connect with grounding means (not shown), and the press fit tails 11 and receptacle contacts 12 of the wafer 1 are used to transfer signal.

Figure 5:
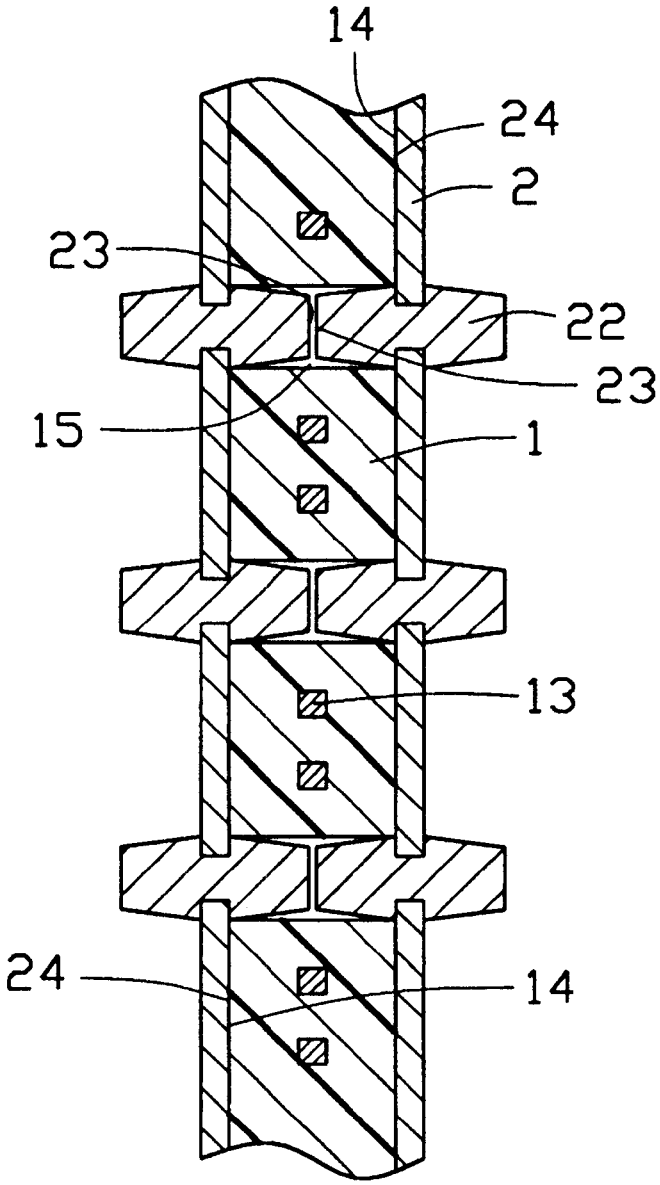
FIG. 5 is a cross-sectional view taken along line 5—5 of FIG. 4.

As best shown in FIGS. 4 and 5, the wafer 1 abuts against two adjacent shielding plates 2 and is partly covered by the receiving plates 30. The shielding plates 2 and ribs 22 further shield each pair of signal contacts 13. As the connector of the present invention provides better means to shield the signal contacts, it is more suitable to be used to transfer high speed and bandwidth signals.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular electrical connector comprising:

a plurality of wafers each having an insulative housing and a plurality of contact elements extending therethrough, said wafer having two side surfaces with slots formed therethrough to isolate each adjacent pair of contact elements within the wafer; and a plurality of shielding plates each having a plurality of ribs extending outwardly from at least one of two side surfaces thereof;

each shielding plate being mounted between two adjacent wafers with each rib fitted within a corresponding slot to shield each adjacent pair of contact elements wherein each of said shielding plates forming ribs piercing into the adjacent wafers in a cooperative alternate arrangement.

2. The electrical connector as claimed in claim 1, wherein the ribs extend outwardly from the two side surfaces of the shielding plate, and the ribs on each side surface are fitted in the slots of an adjacent wafer.

3. The electrical connector as claimed in claim 1, wherein the contact elements have press fit tails and receptacle contacts mutually extending from the insulative housings at right angles, and each shielding plate has press fit tails and receptacle contacts extending in the same directions as the press fit tails and receptacle contacts of the contact elements.

4. The electrical connector as claimed in claim 1, further comprising a plurality of recesses formed in one end of the insulative housing and a plurality of projections extending from the side surface of the shielding plate for engaging with the recesses.

5. The electrical connector as claimed in claim 1, wherein every adjacent two ribs are separated by a channel.

6. The electrical connector as claimed in claim 1, further comprising a receiving plate formed at an edge of the shielding plate near the press fit tails and receptacle contacts, each receiving plate extending vertically to the side surface for partly covering the wafer.

7. A modular electrical connector comprising:

a plurality of wafers side by side arranged with one another, each of said wafers defining an insulative housing with plural pairs of coplanar contact elements embedded therein with two opposite ends exposed outside;

a plurality of metal shielding plates respectively disposed between every adjacent two wafers for isolating electrical communication of the contact elements of the two adjacent wafers in a transverse direction of the connector; wherein:

each of said metal shielding plates further includes a plurality of spaced metallic ribs formed thereon, and said metallic ribs pierce into the corresponding wafer along said transverse direction and isolating electrical communication between every adjacent two pairs of contact elements of said wafer along a plane defined by said wafer which is perpendicular to said transverse direction.

8. The connector as claimed in claim 7, wherein said plurality of ribs of each of said metal shielding plates are formed on two side surfaces thereof and respectively piercing into the corresponding two adjacent wafers by two sides thereof.

9. The connector as claimed in claim 7, wherein each of said wafers receives a plurality of ribs formed on both the two corresponding metal shielding plates sandwiching said each of said wafers therebetween.

* * * * *